United States Patent [19]

Robbins, III et al.

[11] Patent Number: 4,871,264

[45] Date of Patent: Oct. 3, 1989

[54] BAG CLOSURE DEVICE AND METHODS OF FABRICATING THE SAME

[75] Inventors: Edward S. Robbins, III, 459 N. Court St., Florence, Ala. 35630; Theodore J. Onocki, Florence, Ala.

[73] Assignee: Edward S. Robbins, III, Florence, Ala.

[21] Appl. No.: 141,042

[22] Filed: Jan. 5, 1988

[51] Int. Cl.[4] ..... B65D 33/16

[52] U.S. Cl. ..... 383/68; 383/13; 383/78; 383/83

[58] Field of Search ..... 383/13, 6, 25, 29, 31, 383/68, 78, 93

[56] References Cited

U.S. PATENT DOCUMENTS

| | | | |
|---|---|---|---|
| 3,026,017 | 3/1962 | Hopkins | 383/69 |
| 3,141,221 | 7/1964 | Faulls, Jr. | 383/69 |
| 3,912,140 | 10/1975 | Franges | 383/13 |
| 4,009,287 | 2/1977 | Clarke | 383/68 |
| 4,040,562 | 8/1977 | Ward et al. | 383/13 |
| 4,641,360 | 2/1987 | Frank | 383/63 |

*Primary Examiner*—Willis Little

*Attorney, Agent, or Firm*—Nixon & Vanderhye

[57] ABSTRACT

Bag closure devices include elongate male and female members each having a wall which is generally U-shaped in cross-sectional configuration and terminating in a pair of opposing, separated edge regions which define therebetween a slot extending the axial length of the members. The U-shaped walls of the male and female members are formed of a resilient, shape-retaining plastic material (e.g., PE) which permits the opposing edge regions to be resiliently displaced relative to one another so as to facilitate the entry of the male member into a generally cylindrical interior space defined by the female member when the two members are moved into frictional nested relationship. The male and female members are preferably interconnected to one another by an integral hinge which facilitates moving the same into such nested relationship. A locking member may optionally be provided so as to releasably lock the male and female members in their nested relationship. The devices are fabricated by extruding the material into a preform which, in one embodiment, includes oppositely oriented U-shaped preforms of the male and female members separated by a substantially planar central region, the preforms extending parallel to the extrusion axis. In another embodiment, a continuous U-shaped preform is extruded and opposing wall sections thereof are removed to establish the male and female members interconnected to one another by the region which remains after removal of the wall sections.

28 Claims, 3 Drawing Sheets

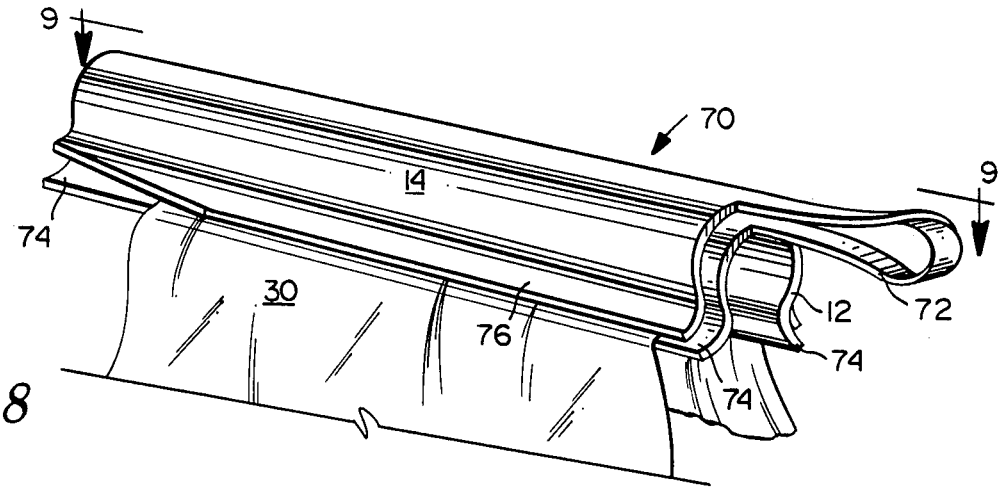
FIG. 8
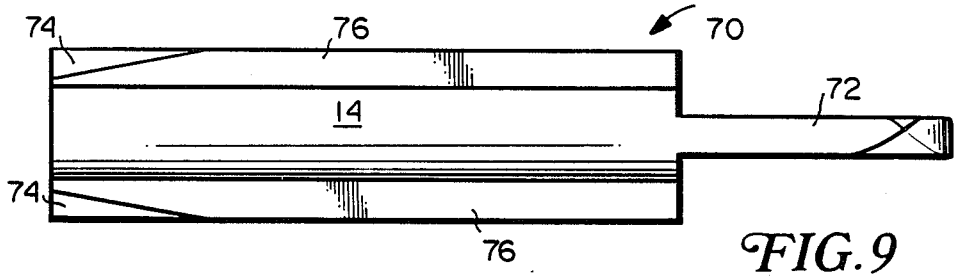
FIG. 9
FIG. 10
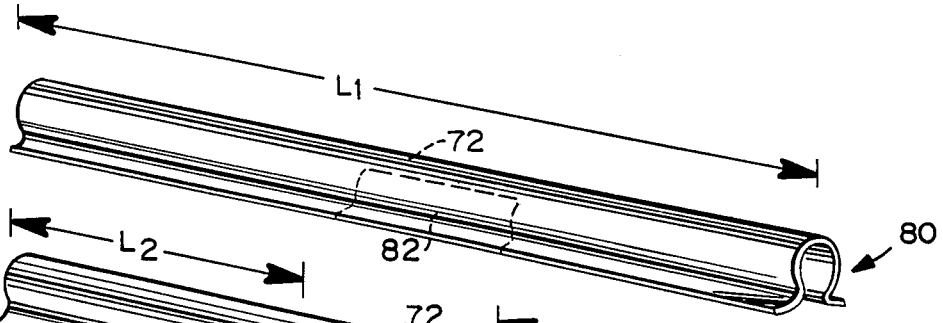
FIG. 11
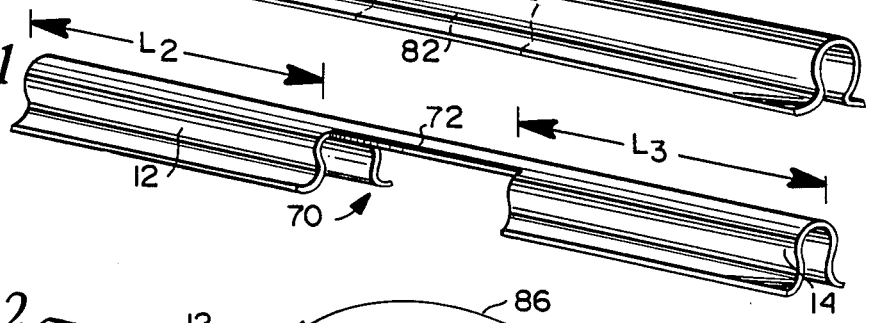
FIG. 12
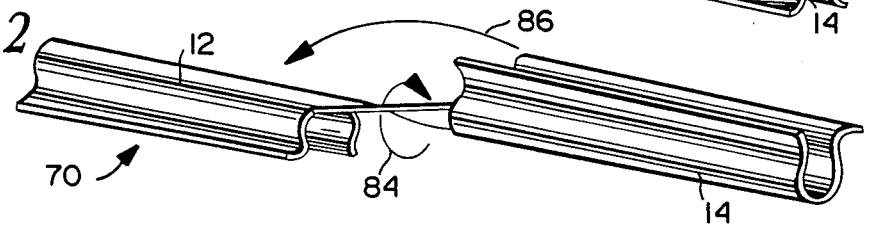

BAG CLOSURE DEVICE AND METHODS OF FABRICATING THE SAME

FIELD OF THE INVENTION

This invention relates to devices of the type used to close flexible bags and to methods of fabricating the same. In preferred embodiments, it includes male and female members each having walls of general U-shaped cross-sectional configuration having terminal edges defining a slot along its elongate extent. The walls of the male and female members are formed of a shape-retaining plastic material thereby permitting resilient displacement of the terminal edges so as to allow the male member to be nested within the female member.

BACKGROUND AND SUMMARY OF THE INVENTION

It is oftentimes desirable to reclose a bag once it has been opened, particularly if the bag contains a food product which would spoil or become stale if the bag was allowed to remain open. Various contrivances have been proposed in the past in order to accomplish such a bag-closure function. For example, U.S. Pat. Nos. 3,266,711 and 2,601,568 each generally propose a bag closure device which includes a female member which defines a cylindrically-shaped interior cavity and a rod-shaped male member adapted to be mateably received within the female member's cavity. In such a manner, the open end of a bag is captured, and thus closed, between the mated male and female members. These prior proposals, while effective for closing an open bag, do not lend themselves to being mass produced easily and economically.

A hinged closure device supports a removable plastic bag adjacent to its mouth in the proposal of U.S. Pat. No. 3,707,271. The device selectively holds the mouth of the plastic bag in an open position so that refuse, etc., may be placed into the bag or in a closed position wherein the mouth of the bag is closed and sealed.

U.S. Pat. No. 3,727,829 suggests that a bag closure device be formed of a unitary body of molded plastic having a plate with upper and lower portions and an elongate slot provided therebetween. Cooperative latching elements are arranged on the upper and lower portions and are engagable with one another when the upper portion is folded over onto the lower portion thereby sealing the bag.

A number of prior devices exist which employ a longitudinally fluted element so as to close a bag or container as exemplified by U.S. Pat. Nos. 1,825,856; 1,699,549; 1,995,210; and 1,794,577. These devices, however, are usually made of rigid metal and are principally intended to seal a bag until opened by a consumer. Hence, devices of this type are not well suited for reclosing the bag once opened.

A waterproof bathing receptacle is disclosed in U.S. Pat No. 1,899,686 as having an inwardly extending concave groove and an outwardly extending convex rib which forcibly press the walls of the flexible container therebetween so as to seal the same when the groove and rib are interfitted.

As the reader will appreciate, there still exists a need in this art for a bag closure device which reliably functions to releasably close the open end of a flexible bag and is capable of being fabricated economically on a mass scale. The present invention is directed to this need.

According to this invention, elongate male and female members are provided, each having a wall which is generally U-shaped in cross-sectional configuration so as to establish an interior space which is generally cylindrical in configuration. The wall of each of the male and female members terminates in a pair of opposing, separated edge regions which define therebetween a slot extending the member's axial length and being of a dimension which is less than the cross-sectional dimension of the defined generally cylindrical space. The walls of each of the male and female members are also formed of a resilient, shape-retaining material which permits the opposing edge regions to be resiliently displaced relative to one another. Thus, the entry of the male member into the defined generally cylindrical space of the female member is facilitated. In such a manner, the male and female members are capable of being frictionally nested with one another so as to capture, and thus close, a bag therebetween.

In one embodiment, the male and female members are joined to one another by a hinge portion (which preferably includes a region of reduced material thickness) extending along the elongate extent of each so as to permit the male and female members to be folded into nested relationship about a hinge axis parallel to the member's elongate axes. In another embodiment, the hinge is in the form of a flexible element which axially joins adjacent ends of the male and female members so as to not only permit the male and female members to be folded about an axis perpendicular to the member's elongate axes, but also allows relative twisting to occur about the member's elongate axes so that the members are capable of being brought into nested relationship with one another.

Structure is preferably provided so as to facilitate separation of the male and female members from their nested relationship thereby allowing the bag to be reopened. Such separation-facilitating structure, according to one embodiment includes a pair of separation tabs each associated with a respective edge region of the male and female members. In this case, one of the tabs preferably projects outwardly to a greater extent as compared to the other of the tabs so as to facilitate manual separation of the two tabs, and hence manual separation of the male and female members. According to another embodiment, the separation-facilitating structure is in the form of a relieved portion defined in an outwardly turned flange of at least one of the male and female members. The relieved portion thus exposes a corresponding portion of the flange associated with the other of the male and female members so as to more easily facilitate manual separation of the two flanges, and hence separation of the male and female members.

The bag closure devices of this invention are most conveniently fabricated by extruding a plastic material into a preform. If the bag closure device includes a hinge portion extending the elongate extent of the male and female members, then the preform includes a substantially planar central region simultaneously extruded with the male and female members, the latter being parallel, but oppositely oriented, to one another. In such a case a handle may be formed in the hinge portion by removing a registerable pair of sections from that region.

If, on the other hand, the bag closure device includes a flexible element axially connecting the male and female members, then the device is most conveniently fabricated by extruding a continuous generally U-shaped preform. Opposing wall sections of the preform may then be removed so as to establish the connecting element and the male and female members axially connected thereby. In either case, the preform may be severed into discrete segments of any preselected length so as to form the final device.

Other features and advantages of this invention will become more clear to the reader after careful consideration is given to the following detailed description of the preferred exemplary embodiments thereof.

BRIEF DESCRIPTION OF THE DRAWINGS

Reference will hereinafter be made to the accompanying drawings wherein like reference numerals throughout the various FIGURES denote like structural elements, and wherein;

FIG. 8 is a side perspective view of yet another embodiment of the bag sealing device of this invention;

FIG. 9 is a top plan view of the device shown in FIG. 8 taken along line 9—9 therein; and FIGS. 10 through 12 sequentially depict the preferred technique for fabricating the bag sealing device of FIGS. 8 and 9.

DETAILED DESCRIPTION OF THE REFERRED EXEMPLARY EMBODIMENTS

Figure 1:
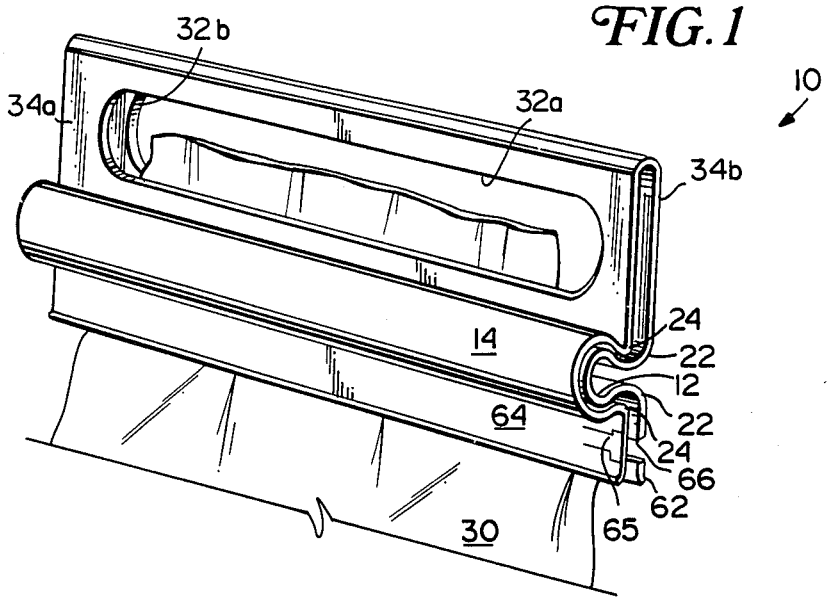
FIG. 1 is a front perspective view of one embodiment of the bag sealing device of this invention shown as being employed to close the open end of a flexible bag.
Figure 2:
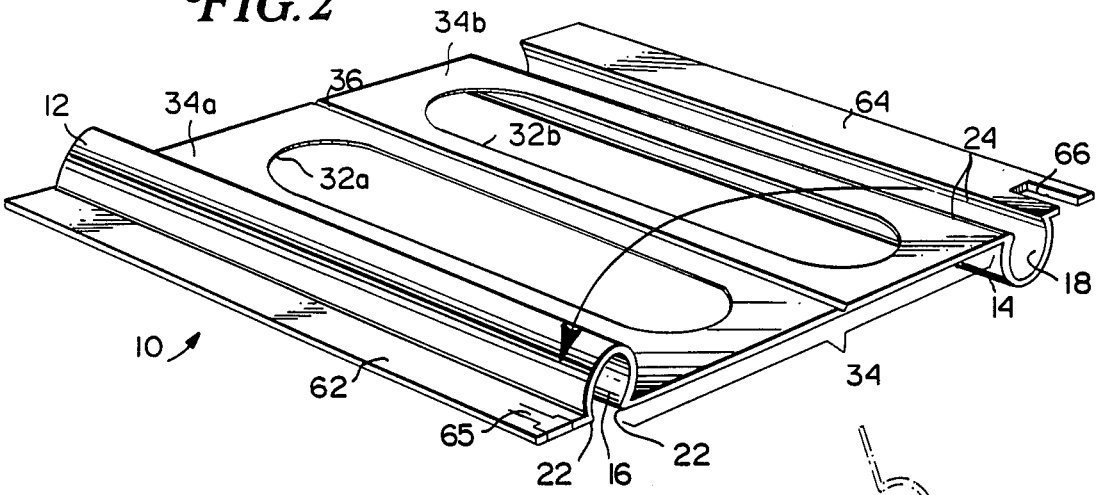
FIG. 2 is a perspective view of the bag closure device shown in FIG. 1, but in an open, disassembled view.
Figure 3:
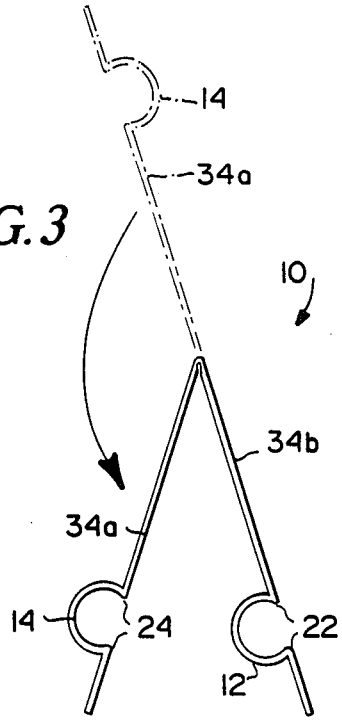
FIG. 3 is an end view of the bag closure device shown in FIGS. 1 and 2 particularly showing the foldable characteristic thereof.

One embodiment of a bag closure device 10 according to this invention is shown in FIGS. 1–3. As is seen, the device 10 includes a male member 12 and a female member 14 each having walls which are generally U-shaped in cross-section and formed of a resilient, shape-retaining plastic material (e.g., PE). Each of the male and female members thus define a generally cylindrical interior cavity 16, 18, respectively. Access to the interior cavities 16, 18, is provided by slots defined between opposing pairs of edge regions 22, 24 of the male and female members 12, 14, respectively.

The edge regions 22, 24 moreover define respective slots therebetween which are of a lesser dimension as compared to the cross-sectional diameter of the cavities 16, 18. Edge regions 22, 24 thus establish a "throat" for cavities 16, 18. Since the male and female members 12, 14 are each formed of a resilient, shape-retaining plastic material, entry of the male member 12 into the cavity 18 of female member 14 will cause the walls of the male and/or female members 12, 14, respectively, to be resiliently displaced. That is, the edge regions 24 spread relative to one another and/or the edge regions 22 contract relative to one another thereby allowing the exterior of male member 12 to be accepted within the cavity of female member 14. Once the male member 12 is nested within the cavity 18 of female member 14, the resilient nature of each will tend to cause the edge regions to return to their normal condition (i.e., will tend to return them to a nondisplaced condition). This in turn, gives rise to frictional engagement between the male and female members 12, 14, respectively, thereby capturing (and hence closing) an open end of a flexible bag 30 therebetween (see FIG. 1).

The device 10 in the embodiment of FIGS. 1–3 includes a handle 32 to permit the device 10/bag 30 to be more easily carried by a user. Handle 32 is formed by a pair of openings **32*a*, 32*b* defined in a respective panel 34*a*, 34*b* of planar central region 34 laterally adjacent a notch 36 which forms a region of reduced material thickness (see FIG. 2). The central region 34 is connected integrally to a respective one of the edge regions 22, 24 of male and female members 14, 16, respectively, and thus extends along the elongate extent of each. Notch 36 thus forms a hinge which permits female member 14 to be folded over onto male member 12 (and vice-versa) as is shown in FIG. 3 so that the two members 14, 16 may then be pressed into frictionally nested relationship as was described previously. That is, the two members 14, 16 are capable of pivoting about an axis established by the notch 34. When the male and female members 14, 16 are in their nested relationship, the openings 32*a* and 32*b* will thus register with one another thereby establishing the graspable handle 32**.

Figure 4:
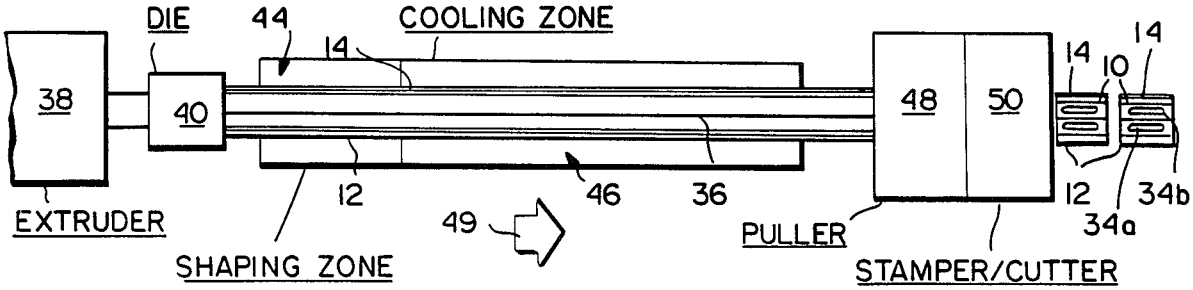
FIG. 4 is a schematic top plan view of an exemplary fabrication scheme particularly for making the bag closure devices of FIG. 1.

A top plan view of one possible scheme for fabricating the device 10 described above is shown schematically in accompanying FIG. 4. As is seen, a plastic material is extruded, by means of a conventional screw extruder 38 and die 40, into a continuous length preform 42 having the general shape and configuration of an opened device 10 (i.e., configured as shown in FIG. 2). Thus, the male and female members of the preform 42 are each generally U-shaped in cross-section but are oppositely oriented with respect to one another (which in the context of drawing FIG. 4 means that the U-shape of male member 12 is downwardly oriented while the U-shape of the female member 14 is upwardly oriented). The preform 42 is then pulled, by means of puller 48, sequentially through a shaping zone 44 (where final produce shaping and sizing occurs with the aid of a suitably configured shaping die) and a cooling zone 46 (where the preform is cooled and solidified so as to retain its shape). The puller 50 thus conveys the preform through the various processing zones in the direction of arrow 49. The openings **32*a* and 32*b* are then formed by means of stamper/cutter 50 while, at the same time, the preform 42 is severed into discrete lengths so as to form the individual devices 10**.

Figure 5:
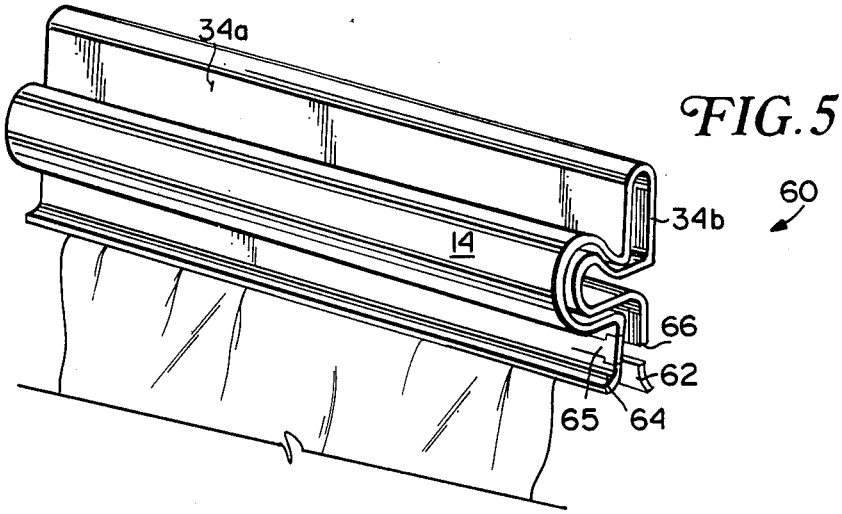
FIG. 5 is a front perspective view of another embodiment of the bag sealing device of this invention.

The exact sequence of opening formation and length severing is not critical. Thus, cutting may precede the stamping (and vice versa) in separate process steps, if desirable. Also, the openings **32*a* , 32*b* need not be formed at all, in which case a device 60 of the type shown in FIG. 5 is fabricated. The panels 34*a*, 34*b* of the device 60 shown in FIG. 5 may be extended outwardly from the nested male and female members 12, 14 so as to provide a region which a user may grip. The device 60 thus obviates the need to form the openings 32*a*, 34*b* in panels 34*a*, 34*b*, respectively, as was the case with the device 10 discussed above with reference to FIGS. 1–3**.

Figure 6:
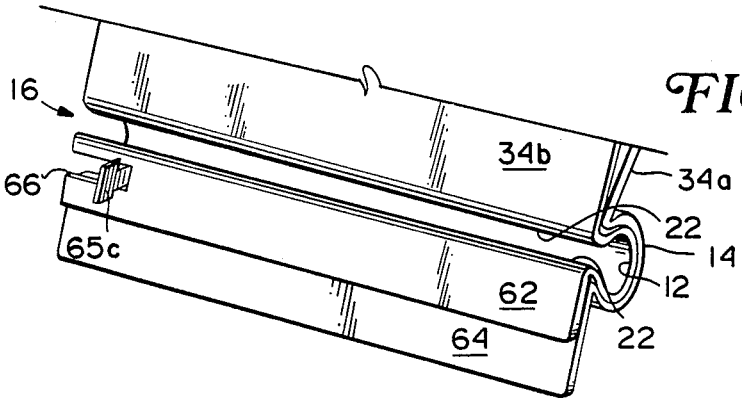
FIG. 6 is a rear perspective view of a modification which may be provided with the embodiments of FIGS. 1 and/or 5.

The devices 10 and 60 may each be provided with tabs 62, 64 respectively outwardly projecting from one of the edge regions 22 and 24 of male and female members 12, 14. Tabs 62 and 64 are thus juxtaposed with one another when the male and female members 12, 14, respectively, are in their frictionally nested relationship and serve to facilitate separation of the two members 12, 14 when it is again desired to open the bag 30. Such separation facilitation may be further enhanced by having one of the tabs extend a greater dimension as compared to the other of the tabs. For example, as shown in FIG. 6, tab 64 associated with female member 14 extends a greater dimension as compared to the dimension of tab 62 associated with male member 12. The grater dimension of tab 64 (or tab 62) thus permits a user to more easily grasp the tabs 62 and 64, and hence, makes it easier to separate male and female members 12, 14, respectively, from their nested relationship.

As may be appreciated, the resilient nature of the devices 10 and 60 may cause a spring force to be exerted upon male and female members 12, 14, relationship, in a direction tending to separate the same. To ensure positive locking of the male and female members 12, 14, respectively, there is optionally provided according to this invention suitable locking means which, in the preferred embodiment, takes the form of a T-shaped locking member 65 and an open ended slot 66 defined in one and the other of the tabs 62 and 64. As shown, locking member 65 is preferably associated with tab 62 while slot 66 is preferably defined in tab 64, but the opposite arrangement could be satisfactorily employed. Also, the locking member 65/slot 66 could, if desired, be formed directly as part of the male and female members 12 and 14, respectively, themselves, or be formed as a part of panels 34*a*, 34*b*.

The locking member 65 is formed by cutting or stamping a T-shaped pattern in tab 64 (as could be accomplished in the stamper/cutter 50—see, FIG. 4) so as to establish an elongate stem portion 65*a* (which preferably extends parallel to the axially elongate dimension of female member 14) having a proximal end 65*b* integrally attached to tab 64 so as to form a "hinge" thereat. The opposite distal end of locking member 65 is preferably formed into a cross-member 65*c* perpendicular to the stem 65*a*.

The slot 66 is formed in tab 62 (as by stamper/cutter 50—see FIG. 4) in a position such that it is in adjacent registry with the stem 65*a* of locking member 65 when the male and female members 12, 14, respectively, are in their nested relationship. The width dimension of stem 65*a* and slot 66 are substantially equal to one another while the width dimension of the cross-member 65*c* is greater than the width of stem 65*a* and, particularly, slot 66.

Figure 7:
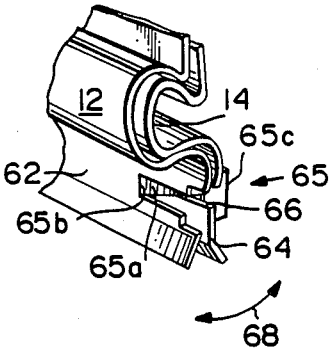
FIG. 7 is a close-up perspective view of an optional locking means which may be provided in accordance with the present invention.

As is seen in FIG. 7, the stem 65*a* is foldable (arrow 68) about the integral "hinge" formed at the end 65*b* thereof. In such a manner, a portion of the stem 65*a* will enter slot 66 in adjacent registry therewith so that the cross-member 65*c* extends behind tab 64. The resilient nature of the devices 10 and 60 will, in turn, tend to separate the male and female members 12 and 14, respectively, (and hence also tend to separate the tabs 62 and 64) so as to cause the cross-member 65*c* to bear against the back of tab 64 thereby preventing such separation. That is, the cross-member 65*c* serves to lock the tabs 62 and 64 in their adjacent positions thereby assisting in maintaining the male and female members in their nested relationship. Of course, the locking member 65 may be manipulated so as to disengage stem 65*a* from slot 66 thereby permitting the male and female members 12, 14, respectively, to be separated when desired.

Another embodiment of a bag closure device 70 according to this invention is shown in accompanying FIGS. 8 and 9. The device 70 is similar to devices 10 and 60 described previously in that it includes generally U-shaped male and female members 12, 14, respectively. However, it differs in that a flexible connector 72 extends axially between adjacent ends of the members 12 and 14. Preferably, connector 72 is integral with each of the members 12 and 14 and thus is formed of the same material. However, it may be separately provided and attached to members 12 and 14, if desired.

The bag closure device also preferably includes pairs of outwardly turned flanges 74, 76, associated with the terminal edge portions 22, 24 of the male and female members 12, 14, respectively. The flanges 74, 76, like tabs 62 and 64 of the devices 10 and 60 described previously, facilitate the separation of the male and female members 12 and 14, respectively, when they are in their frictionally nested relationship.

Separation of the members 12 and 14 may further be enhanced by forming a relieved portion on one of the flanges 74 or 76 so that the other of the flanges 74 or 76 in juxtaposition therewith (when the members 12 and 14 are nested) is exposed thereby permitting the flanges 74 and 76 to be more easily manually manipulated. In FIGS. 8 and 9, the relieved portion 78 just happens to be formed in flanges 76 so that flanges 74 are exposed but the opposite could also be provided (i.e., relieved portion 78 could be formed in flanges 74 so that flanges 76 are exposed thereby). Moreover, only one such relieved portion 78 is necessary, although a pair of relieved portions are preferred as shown in FIGS. 8 and 9.

The steps to fabricate device 70 are generally similar to those employed to fabricate devices 10 and 60 described above with reference to FIG. 4. However, the extruder 38 and die 40 form a continuous generally U-shaped cross-section preform 80 as is shown in accompanying FIG. 10. The preform 80 may be severed in stamper/cutter 50 to form discrete lengths thereof (i.e., length $L_1$ as shown in FIG. 10). The cutter/stamper 50 also removes opposing wall sections 82 (only one such wall section 82 being visible in dashed line in FIG. 10) so as to form device 70 as shown in FIG. 11. What remains after sections 82 are removed are the connector 72 and male and female portions 12 and 14 having lengths $L_2$ and $L_3$, respectively. As before, removal of sections 82 may precede severing of the preform into discrete lengths $L_1$ (or vice versa). The connector 72 thus permits the male and female members 12 and 14, respectively, of the formed devices 70 to be twisted along an axis parallel to the members 12, 14 elongate axis (arrow 84 in FIG. 12) and also permit male and female members 12, 14, respectively, to be pivoted about an axis perpendicular to their elongate axes (i.e., as in arrow 86 in FIG. 12). In such a manner, the members 12 and 14 may be moved into and out of their nested relationship so as to capture and thus close the open end of a flexible bag therebetween.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bag closure device comprising:

elongate male and female members each having a wall which is generally U-shaped in cross-sectional configuration so as to establish an interior space which is generally cylindrical in configuration;

said wall of each of said male and female members terminating in a pair of opposing, separated edge regions which define therebetween a slot extending the axial length thereof and being of a dimension which is less than the cross-sectional dimension of said generally cylindrical space;

said wall of each of said male and female members also being formed of a resilient, shape-retaining material means which permits said opposing edge regions to be resiliently displaced relative to one another so as to facilitate the entry of said male member into said generally cylindrical space of said female member, whereby said male and female members are frictionally nestable with one another so as to capture, and thus close, a bag therebetween, and locking means for releasably locking said male and female members in said nesting relationship, and locking means including, (i) a locking member, and (ii) and open ended slot in adjacent registry with said locking member when said male and female members are in said nesting relationship, (iii) said locking member being foldable into and out of engagement with said slot thereby releasably locking said male and female members in said nesting relationship.

2. A bag closure device as in claim 1, further comprising a pair of tabs respectively associated with said male and female members, said tabs extend outwardly from said respective male and female members along the axial extent thereof, and wherein said locking member is formed in one of said tabs while said slot is defined in the other of said tabs.

3. A bag closure device as in claim 2, wherein said locking member includes a stem, a proximal end of said stem being integrally connected to said one tab so as to form a hinge thereat about which said locking member is foldable.

4. A bag closure device as in claim 3, wherein a distal end of said stem includes a cross-member having a width greater than said slot so as to engage a back surface of said other tab and thereby releasably lock said one and other tabs, and hence said male and female members, one to the other.

5. A bag closure device as in claim 2, wherein said locking member is generally T-shaped in configuration.

6. A bag closure device as in claim 1, further comprising hinge means integrally joining said male and female members to permit the same to be moved into said frictionally nested relationship.

7. A bag closure device as in claim 6, wherein said hinge means axially joins one end of said male member to an adjacent end of said female member, said hinge means permitting relative twisting motion to be applied to said male and/or female members about their respective elongate axes, in addition to permitting said male and female members to be pivoted relative to one another about an axis transverse to said elongate axis.

8. A bag closure device as in claim 6, wherein said hinge means integrally joins one of said edge regions of each said male and female members along substantially the entire axial extent of each so that said male and female members are pivotally movable relative to one another about a hinge axis which is parallel to their respective elongate axes.

9. A bag closure device as in claim 8, wherein said hinge means includes a region of reduced thickness extending parallel to said elongate axes of said male and female members .

10. A bag closure device as in claim 8, wherein said hinge means includes;

a pair of opposing hinge panels which are juxtaposed when said male and female members are in said nested relationship, one end of said hinge panels being joined to a respective said one edge region of said male and female members along substantially the entire axial extent of each; and a hinge portion joining the other ends of said pair of hinge panels one to the other.

11. A bag closure device as in claim 10, wherein said hinge portion is provided by means of a region of reduced thickness extending between and parallel to said male and female members.

12. A bag closure device as in claim 10, wherein each said hinge panel defines an opening and wherein said openings of both said hinge panels are in registry with one another when said male and female members are in said nested relationship so as to form a handle which more easily permits the said bag closure device to be grasped and carried.

13. A bag closure device comprising elongate male and female members each having a wall which is generally U-shaped in cross-sectional configuration so as to establish an interior space which is generally cylindrical in configuration;

said wall of each of said male and female members terminating in a pair of opposing, separated edge regions which define therebetween a slot extending the axial length thereof and being of a dimension which is less than the cross-sectional dimension of said generally cylindrical space;

said wall of each of said male and female members also being formed of a resilient, shape-retaining material means which permits said opposing edge regions to be resiliently displaced relative to one another so as to facilitate the entry of said male-member into said generally cylindrical space of said female-member, whereby said male and female members are frictionally nestable with one another so as to capture, and thus close, a bag therebetween;

said bag closure device further comprising means which facilitate separation of said male and female members from said nesting relationship to permit said bag to be reopened; wherein said separation facilitating means includes a pair of separation tabs each associated with a respective edge region of said male and female members so as to facilitate the manual separation of said male and female members from said nested relationship.

14. A bag closure device as in claim 13, further comprising means for releasably locking said male and female members in said nesting relationship.

15. A bag closure device as in claim 14, wherein said locking means includes a locking member, and an open ended slot in adjacent registry with one another when said male and female members are in said nested relationship, said locking member being foldable into and out of engagement with said slot thereby releasably locking said male and female members in said nesting relationship.

16. A bag closure device as in claim 15, further comprising a pair of tabs respectively associated with said male and female members, said tabs extend outwardly from said respective male and female members along the axial extent thereof, and wherein said locking member is formed in one of said tabs while said slot is defined in the other of said tabs.

17. A bag closure device as in claim 16, wherein said locking member includes a stem, a proximal end of said stem being integrally connected to said one tab so as to form a hinge there at about which said locking member is foldable.

18. A bag closure device as in claim 17, wherein a distal end of said stem includes a cross-member having a width greater than said slot so as to engage a back surface of said other tab and thereby releasably lock said one and other tabs, and hence said male and female members, one to the other.

19. A bag closure device as in claim 16, wherein said locking member is generally T-shaped in configuration.

20. A bag closure device as in claim 13, wherein one of said tabs projects outwardly to a greater dimension as compared to the other of said tabs.

21. A bag closure device comprising:

elongate male and female members each having a wall which is generally U-shaped is cross-sectional configuration so as to establish an interior space which is generally cylindrical in configuration;

said wall of each of said male and female members terminating in a pair of opposing, separated edge regions which define therebetween a slot extending the axial length thereof and being of a dimension which is less than the cross-sectional dimension of said generally cylindrical space;

said wall of each of said male and female members also being formed of a resilient, shape-retaining material means which permits said opposing edge regions to be resiliently displaced relative to one another so as to facilitate the entry of said male member into said general cylindrical space of said female-member, whereby said male and female members are frictionally nestable with one another so as to capture, and thus close, a bag therebetween, wherein said bag closure device further comprises pairs of outwardly turned flanges joined to respective said edge regions of said male and female members, wherein each flange of said male-member is in juxtaposed relationship to a respective flange of said female-member when the said male and female members are in said nesting relationship, and means which facilitate separation of said male and female members from said nested relationship to permit said bag to be reopened, and wherein said separation facilitating means is provided by a relieved portion formed in one of said flanges of said male and/or female member so as to expose a corresponding portion of the other of said flanges of said male and/or female members in juxtaposition therewith.

22. A method of fabricating a bag closure device of the type having frictionally nestable male and female members, comprising the steps of:

(a) extruding a plastic material along an extrusion axis which lies within a substantially planar extrusion path so as to form a unitary bag closure preform having a pair of generally U-shaped elongate male and female members integrally interconnected to one another by a substantially planar central region which is substantially coplanar to said planar extrusion path, wherein each of said generally U-shaped male and female members extends essentially parallel to said extrusion axis and includes a pair of opposing spaced-apart edge regions which extend along said extrusion axis so as to define therebetween a slot which extends along a linear extent of said male and female members, respectively, said slot of one of said male and female members being oriented in a first direction relative to said extrusion plane, and said slot of the other of said male and female members being oriented in a second direction, opposite to said first direction, relative to said extrusion plane;

(b) forming a region of reduced thickness in said central region between and parallel to said linear extent of said oppositely oriented male and female members so that said male and female members are hingeably connected to one another by means of said reduced thickness region to permit the same to be folded into frictional nestable relationship with one another;

(c) forming a graspable handle integral with said male and female members by removing a registerable pair of sections from said central region so as to form a corresponding pair of openings therethrough, whereby said openings register with one another when said male and female members are folded into said nestable relationship thereby providing a graspable handle; and then (d) severing said preform in predetermined discrete lengths so as to form individual ones of said bag closure device.

23. A method as in claim 22, wherein said step of forming said region of reduced thickness is practiced by extruding said plastic material through a die which forms a notch in said central section.

24. A method of fabricating a bag closure device of the type having frictionally nestable, generally U-shaped elongate male and female members from a plastic material comprising the steps of:

(a) extruding plastic material along an extrusion axis to form a substantially uniform continuous elongate preform of predetermined length, the preform having a generally U-shaped wall which defines between opposing ends thereof a continuous concave interior surface and a continuous convex exterior surface, said preform terminating in a pair of opposing spaced-apart edge regions which extend axially along said extrusion axis and which define therebetween a slot extending the axial length of said preform; and then (b) removing opposing wall sections of the preform so as to establish a flexible connecting portion which extends axially along said extrusion axis, said step of removing said opposing wall sections including forming opposing open regions in said generally U-shaped wall of said preform at a location between said opposing ends of said preform such that each of said opposing open regions extends (i) along a predetermined axial length of said preform and, (ii) circumferentially along axially spaced-apart edges from a respective one of said edge regions to an axially extending upper edge, wherein said connecting portion is established between said axially extending upper edges defined by said opposing open regions by virtue of a flexible section of said generally U-shaped wall which remains when said opposing wall sections are removed, whereby said male and female members are established are interconnected by said connecting portion.

25. A method as in claim 24, wherein step (a) is practiced by extruding the plastic material into a continuous U-shaped preform whose length corresponds to a number of said bag closure devices.

26. A method as in claim 25 where in step (b) is practiced by removing said opposing wall sections at spaced-apart sequential locations along the length of said preform, said method then including the step of severing said preform transversely to its elongation between said removed wall sections so as to form said number of bag closure devices.

27. A method as in claim 26, wherein said steps of removing said opposing wall sections and severing said preform are practiced simultaneously.

28. A method as in claim 26, wherein said step of removing said opposing wall sections is practiced before said step of severing said preform.

* * * * *